US006893327B2

(12) United States Patent
Kajiwara et al.

(10) Patent No.: US 6,893,327 B2
(45) Date of Patent: May 17, 2005

(54) CHEMICAL MECHANICAL POLISHING APPARATUS AND METHOD HAVING A RETAINING RING WITH A CONTOURED SURFACE

(75) Inventors: Jiro Kajiwara, Cupertino, CA (US); Gerard S. Moloney, Milpitas, CA (US); Huey-Ming Wang, Fremont, CA (US); Junsheng Yang, Sunnyvale, CA (US)

(73) Assignee: Multi Planar Technologies, Inc., San Jose, CA (US)

( * ) Notice: Subject to any disclaimer, the term of this patent is extended or adjusted under 35 U.S.C. 154(b) by 367 days.

(21) Appl. No.: 09/874,174

(22) Filed: Jun. 4, 2001

(65) Prior Publication Data

US 2002/0182867 A1 Dec. 5, 2002

(51) Int. Cl.[7] ..... B24B 1/00

(52) U.S. Cl. ..... 451/41; 451/285; 451/289; 451/397; 451/398

(58) Field of Search ..... 451/41, 285, 287, 451/288, 397, 398, 290

(56) References Cited

U.S. PATENT DOCUMENTS

| | | | | |
|---|---|---|---|---|
| 5,643,061 A | | 7/1997 | Jackson et al. | |
| 6,116,992 A | | 9/2000 | Prince | |
| 6,136,715 A | * | 10/2000 | Shendon et al. | 438/692 |
| 6,162,116 A | * | 12/2000 | Zuniga et al. | 451/285 |
| 6,231,428 B1 | | 5/2001 | Maloney et al. | |
| 6,419,567 B1 | * | 7/2002 | Glashauser | 451/259 |
| 6,527,624 B1 | * | 3/2003 | Tolles et al. | 451/41 |

FOREIGN PATENT DOCUMENTS

| | | |
|---|---|---|
| GB | 2307342 A | 5/1997 |
| GB | 2315694 A | 2/1998 |
| JP | 09-309065 | 12/1997 |
| JP | 10-217108 | 8/1998 |
| JP | 11-333712 | 10/1999 |

* cited by examiner

*Primary Examiner*—Eileen P. Morgan
(74) *Attorney, Agent, or Firm*—Dorsey & Whitney

(57) ABSTRACT

A system (100) and method for polishing and planarizing a substrate (105) is provided that reduces non-uniformities in the removal of material from the edge of the substrate due to a rebound effect. In one embodiment system (100) includes a polishing head (140) having a carrier (155), a subcarrier (160) carried by the carrier and adapted to hold the substrate during a polishing operation, and a retaining ring (170) having an inner edge (220) disposed about the subcarrier. A lower surface (210) of the retaining ring (170) is in contact with a polishing surface (125) during the polishing operation, and has at least one annular recess (215) formed therein to enable the polishing surface compressed under the retaining ring to rebound into the annular recess, thereby reducing the rebound effect and inhibiting non-planar polishing of the surface of the substrate (105).

43 Claims, 7 Drawing Sheets

CHEMICAL MECHANICAL POLISHING APPARATUS AND METHOD HAVING A RETAINING RING WITH A CONTOURED SURFACE

FIELD

This invention pertains generally to systems, devices, and methods for polishing and planarizing substrates, and more particularly to a Chemical Mechanical Planarization or Polishing (CMP) apparatus and method.

BACKGROUND

Chemical Mechanical Planarization or Polishing, commonly referred to as CMP, is a method of planarizing or polishing a semiconductor wafer or other type of substrate. A typical CMP apparatus includes a platen having a polishing pad thereon, a polishing head for holding the substrate thereon, and a mechanism for providing relative movement between the polishing head and the pad. Referring to FIG. 1, the polishing head 12 includes a carrier 14 having a subcarrier 16 with a lower surface 18 for pressing the substrate 20 against the polishing pad (not shown) during the polishing operation, and a retaining ring 22 circumferentially disposed about the subcarrier. The retaining ring 22 generally restrains or limits lateral movement of the substrate 20 relative to the subcarrier 16 to hold or retain the substrate between the subcarrier and the polishing pad. Generally, the polishing head 12 further includes a backing ring 24 through which a force may be applied to the retaining ring 22, and chambers 26, 28, above the subcarrier 16 and the backing ring 24 respectively that may be pressurized to urge or force the retaining ring 22 and the subcarrier 16, with the substrate 20 thereon, against the polishing pad. Typically, the chambers 26, 28 above the backing ring 24 and subcarrier 16 are separate so that the force applied to the substrate 20 and to the retaining ring 22 can be controlled independently.

Planarizing or polishing a surface of a semiconductor substrate, for example, between certain processing steps allows more circuit layers to be built vertically onto a device. However, as feature size decreases, density increases, and the size of substrates increase, CMP process requirements become more stringent. Substrate to substrate process uniformity as well as uniformity of planarization across the surface of a substrate are important issues from the standpoint of producing semiconductor products at a low cost. As the size of structures or features on the substrate surface have been reduced to smaller and smaller sizes, now typically about 0.2 microns, the problems associated with non-uniform planarization have increased. This problem is sometimes referred to as a Within Wafer Non-Uniformity (WIWNU) problem.

Many reasons are known in the art to contribute to non-uniformity problems. These include edge effect non-uniformities arising from the typically different interaction between the polishing pad at the edge of the substrate 20 as compared to at the central region. Typically, more material is removed from the edge of the substrate 20 than at the center. That is the edge of the substrate 20 is over polished. This is known as the edge effect. Many attempts have been made in the art to correct or compensate for the edge effect. However, efforts to solve this problem have not heretofore been completely successful.

One approach in an attempt to correct this over polishing of the edge of the substrate 20, has been to apply a somewhat higher force to the retaining ring 22 than to the subcarrier 16.

The polishing pad under the retaining ring 22 is deformed or compressed with the effect that the force between the surface of the polishing pad and the surface of the substrate 20 near its edge is reduced. This results in less material being removed from the surface of the substrate 20 near its edge.

While an improvement over earlier designs, this approach is not an entirely satisfactory solution. One problem with this approach, graphically illustrated in FIG. 2, is that as the polishing pad deforms under pressure of the retaining ring 22 during the polishing operation, it is pulled away from the surface of the outer edge of the substrate 20 adjacent to an inner edge of the retaining ring 24. Thus, the approach described above can change the situation from one in which too much material is removed from the surface of the substrate 20 near its edge to one in which too little is removed. The usual method of controlling this rebound effect, as it is commonly known, is to attempt to limit pad deformation by achieving an exacting balance between force applied to the subcarrier 16 and the retaining ring 22. That is as the force applied to the retaining ring 22 rises, the force applied to the subcarrier 16 is also increased. When properly balanced, both the size of the area near the edge of the substrate 20 separated from the polishing pad, rebound effect, and over polishing of the surface near the edge of the substrate, edge effect, is reduced. However, achieving and maintaining such an exacting balance can be extremely difficult given the changes in polishing pad thickness and properties likely to occur over time. Achieving such a balance can be impossible where the pad deformation exceeds that which can be compensated for within the limits of an available range of force that can be applied to the subcarrier 16 and the retaining ring 22, or within the limits of force that can be applied to the substrate 20. This is particularly a problem with the latest generation of polishing pads using materials having viscoelastic properties, such as polyurethane, commercially available from RODEL of Newark Del. By viscoelastic it is meant the material of the polishing pad exhibits different elastic properties to force applied in different directions, or for different lengths of time.

Another prior art approach is to provide harder polishing pads less susceptible to deformation. This approach however is often neither possible nor desirable for a number of reasons. In the first place, some limited amount of deformation is necessary to prevent excess removal of material near the edge of the surface of the substrate 20, therefore using a harder, less compliant material for the pad would diminish the benefit of using a retaining ring 22. Moreover, using a harder, less compliant material for the polishing pad would decrease deformation of the polishing pad, could actually increase the rebound effect since the harder material, being less flexible, would take a greater time to recover from the deformation. Thus, for a polishing head 12 moving at a given speed over the polishing pad, the distance between the inner edge of the retaining ring 22 and the point at which the polishing pad has rebounded sufficiently to touch the surface of the substrate 20 would increase for a harder polishing pad.

Accordingly, there is a need for a CMP apparatus and method that reduces if not eliminates excess removal of material from the surface near the edge of a substrate (that is reducing the edge effect) while also reducing the area near the edge of the substrate 20 separated from the polishing pad (that is reducing the rebound effect).

Another problem with conventional retaining rings 22 arises from the fact that they are consumable items, having a lower surface 30 from which a thin layer of material is removed during the polishing operation. Moreover, as shown in FIG. 3 retaining rings 22 are often made of a polycrystalline ceramic material that includes a number of partial crystals 32 along the lower surface 30. Partial crystals 32 are created by machining a flat surface on a molded retaining ring core, thereby creating a surface that generally includes many partial crystals. These partial crystals 32 are held in place by mechanically interlocking with other surrounding whole crystals 34 and partial crystals. As the retaining ring 22 wears from the original lower surface 30 to that represented by line 36 in FIG. 3, the mechanical interlocking can be destroyed as a result of the wear that occurs during one or a succession of polishing operations, allowing partial crystals 32 or chips of ceramic material to become dislodged and trapped between the substrate 20 and the polishing pad during a polishing operation. This in turn can damage the surface of the substrate 20, rendering it completely worthless. A loss, depending on the point in processing, of up to several thousand or even tens of thousands of dollars. In CMP apparatus having multiple heads 12, several substrates (e.g., wafers) may be lost.

Many attempts have been made in the prior art to solve this problem, including manufacturing retaining rings 22 out of metal. However, metal has proven to be generally unsuitable for retaining rings 22 for a number of reasons. In the field of semiconductor manufacturing, metal is undesirable due to the possibility of metal contamination of the substrate 20 by material removed from the retaining ring 22 during the polishing operation. Moreover, it is generally desirable that some material be removed from the lower surface 30 of the retaining ring 22 during the polishing operation to maintain a highly planar surface on the retaining ring without which the WIWNU might be increased. For a further explanation of the effect of a non-planar retaining ring surface on the WIWNU refer to commonly assigned, co-pending U.S. patent application Ser. No. 09/652,855 filed Aug. 31, 2000 and entitled Chemical Mechanical Polishing Apparatus and Method Having a Rotating Retaining Ring, which is incorporated herein by reference. The negligible removal rate of material from the lower surface 30 of a metal retaining ring 22, might inhibit this conditioning from occurring. In addition, because retaining rings are considered consumable items, the expense of providing an initially highly planar lower surface 30 on a metal retaining ring 22 would add significantly to operating costs of the CMP apparatus.

An attempt has also been made to solve this problem, by making retaining rings 22 out of Techtron®. Techtron® is a plastic, commercially available from DSM Engineering Plastic Products, of Reading, Pa. Because it is a plastic, retaining rings 22 constructed of this material avoid the chipping problem of ceramic rings and the potential contamination of metal retaining rings. However, retaining rings 22 made of Techtron® exhibit excessive and rapid wear leading to a lower useful lifetime for the retaining ring. This is undesirable since, in addition to the expense of the retaining ring 22 itself, replacing it generally involves a considerable amount of equipment downtime to (i) run-in or season the new retaining ring, and (ii) to characterize and/or set process parameters with the new retaining ring. Challenges in setting the process may involve changing rotation speed, pressure, time and the like.

Therefore, there remains a need for a CMP apparatus and method that reduces if not eliminates excess removal of material from the surface near the edge of a substrate, referred to as edge effect, while also reducing the area near the edge of the substrate separated from the polishing pad, referred to as rebound effect. There is also a need for a retaining ring that avoids the chipping or spalling problem of ceramic retaining rings and the potential contamination of metal retaining rings, while providing an acceptable useful life.

SUMMARY

The present invention relates to a CMP apparatus and method for polishing and planarizing substrates that minimizes or eliminates non-uniformities in the removal of material from the edge of a substrate due to the rebound effect, and that avoids potential damage to the substrate due to chipping or spalling.

According to one aspect of the present invention, a polishing head for positioning a substrate having a surface on a polishing surface of a polishing apparatus. The polishing head includes a carrier, a subcarrier carried by the carrier and adapted to hold the substrate during a polishing operation, and a retaining ring having an inner edge disposed about the subcarrier. The lower surface of the retaining ring is in contact with the polishing surface during the polishing operation, and has at least one annular recess formed therein to inhibit non-planar polishing of the surface of the substrate.

In one embodiment, the polishing surface includes a pad of a pliant material capable of being deformed by the retaining ring during a polishing operation, and the annular recess is adapted to reduce an area near an edge of the substrate having a lower polishing rate than a center of the substrate due to rebounding of the pad from a deformed condition in a first region near the inner edge of the retaining ring. This is accomplished by enabling the pad to partially or completely rebound within the annular recess, thereby reducing the time and distance which a pad moving past the retaining ring from an outer surface to an inner edge is reduced. As a result deformed pad in the first region passing out from under the inner edge of the retaining ring rebounds more quickly to contact the surface of the substrate. In one version of this embodiment, the annular recess is positioned a predetermined distance from the inner edge of the retaining ring, the predetermined distance selected to reduce the area near the edge of the substrate having a lower polishing rate. The predetermined distance is selected based on the magnitude of a force applied to the retaining ring and the subcarrier during the polishing operation, and on a hardness of the pad.

In another version of this embodiment, the annular recess is a groove having a predetermined depth and a predetermined radial width selected to reduce the area near the edge of the substrate having a lower polishing rate due to rebounding of the pad. Again, the predetermined depth and radial width are selected based on the magnitude of a force applied to the retaining ring and the subcarrier during the polishing operation, and on a hardness of the pad.

In other embodiments, the annular recess can include a groove having a curved or hemispherical radial cross-section, or a number of concentric grooves. In the last embodiment each of the individual grooves have radial width less than that of a single groove or recess, but the combined width of all the grooves can equal or exceed that of the single groove. Generally, the depth of the concentric grooves is the same or less that of a single recess. However that need not be the case, nor do the depths of the concentric need to be equal to one another. It should also be noted that the concentric grooves need not be equal in radial width to one another. For example, it may be desirable to concentric grooves in which the width and/or depth of individual increases in proportion to their proximity to the inner edge of the retaining ring to rebound more quickly.

The retaining ring is particularly useful in a CMP apparatus for polishing and planarizing semiconductor substrates. The CMP apparatus typically includes in addition to a polishing head having a retaining ring according to an embodiment of the present invention a dispensing mechanism adapted to dispense a chemical, such as a slurry or water, onto the polishing surface during the polishing operation, and a drive mechanism adapted to move the polishing head relative to the polishing surface during the polishing operation.

In another aspect the present invention is directed to a retaining ring made of a polymer to reduce or eliminate potential damage to the substrate during the polishing operation due to spalling or chipping of material from the lower surface of the retaining ring, as is common with conventional ceramic retaining rings. In one embodiment, the polishing head includes a carrier having a subcarrier adapted to hold the substrate during the polishing operation, and a polymer retaining ring disposed about the subcarrier and having a lower surface in contact with the polishing surface during the polishing operation. The polymer retaining ring resists spalling during the polishing operation, thereby reducing or eliminating damage to the substrate. Preferably, the polymer is selected to provide an operating life for the retaining ring of at least about 70 hours, and more preferably an operating life adequate for processing from about 2,000 to about 10,000 substrates.

In one embodiment, the retaining ring is made entirely or in part of a polymer selected from a group consisting of polyesters, polyethylene terephthalate, polyimide, polyphenylene sulfide, polyetherketone, and polybenzimidazole. Optionally, the lower surface of the retaining ring can further include at least one annular recess formed therein, as described above, to inhibit non-planar polishing of the surface of the substrate.

BRIEF DESCRIPTION OF THE DRAWINGS

These and various other features and advantages of the present invention will be apparent upon reading of the following detailed description in conjunction with the accompanying drawings, where.

DETAILED DESCRIPTION

An improved method and apparatus for polishing or planarization of substrates is provided. In the following description numerous embodiments are set forth including specific details such as specific structures, arrangement, materials, shapes etc. It will be obvious, however, to one skilled in the art that the present invention may be practiced without these specific details, and the method and apparatus of the present invention is not so limited.

Figure 1:
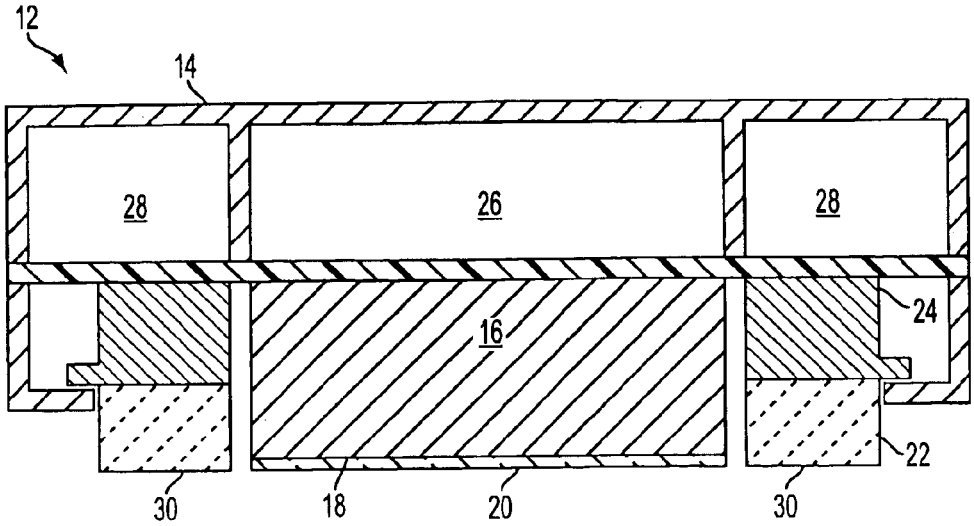
FIG. 1 (PRIOR ART)
FIG. 1 is a block diagram of a conventional polishing or CMP head having a retaining ring.
Figure 2:
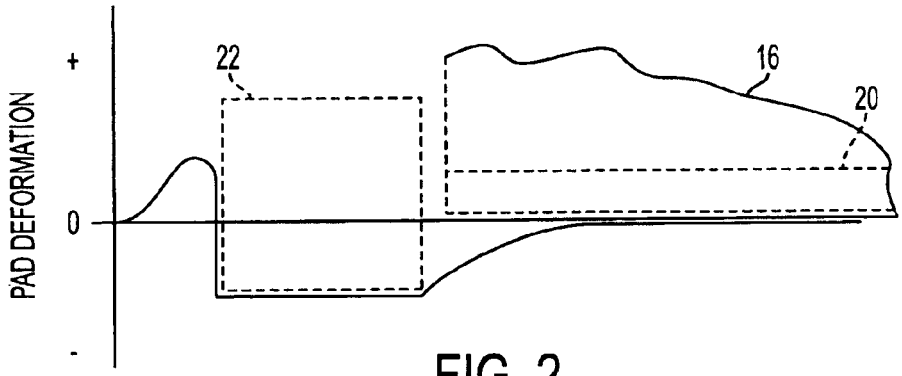
FIG. 2 (PRIOR ART)
FIG. 2 is a schematic sectional side view of a conventional CMP head and a polishing pad showing a rebound effect caused be deformation of the polishing pad by a conventional retaining ring.
Figure 3:
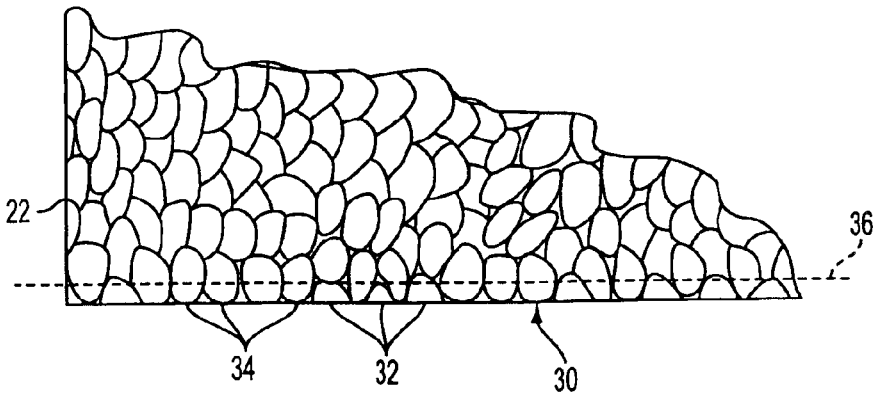
FIG. 3 (PRIOR ART)
FIG. 3 is a partial sectional side view of a conventional ceramic retaining ring showing the interlocking and non-interlocking ceramic crystals.
Figure 4:
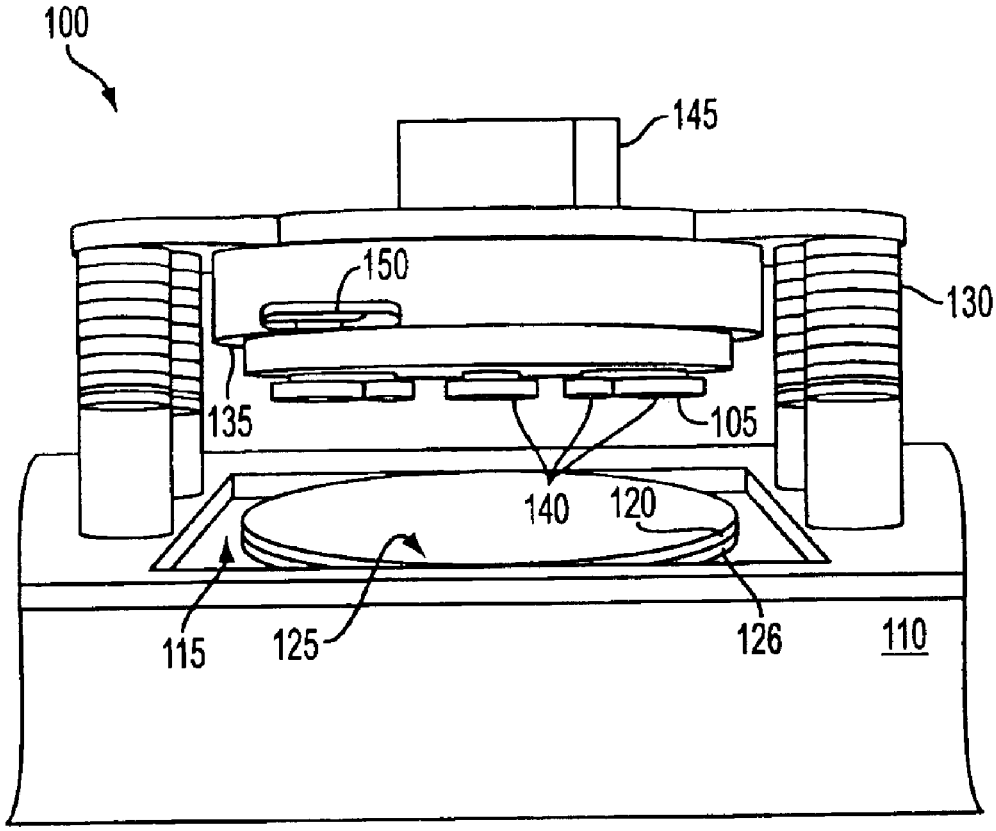
FIG. 4 is a diagrammatic illustration showing an exemplary multi-head polishing or planarization apparatus.

Referring to FIG. 4, there is shown an embodiment of a chemical mechanical polishing or planarization (CMP) apparatus 100 for polishing substrates 105. This particular embodiment provides multiple heads in a carousel arrangement, however, other types of single head machines are known. As used here the term "polishing" means either polishing or planarization of substrates 105, including substrates used in optical systems, windows, flat panel displays, solar cells, and, in particular, semiconductor substrates or wafers on which electronic circuit elements have been or will be formed. Semiconductor wafers are typically thin and fragile disks having diameters nominally between about 100 and about 400 millimeters (mm). Currently 100, 200, 300 and 400 mm semiconductor wafers are widely used in the industry. The inventive method and apparatus 100 are applicable to semiconductor wafers and other substrates 105 at least up to 400 mm diameter as well as to larger diameter substrates, such as for example flat panel LCD displays having 16 inch or larger diameters.

For purposes of clarity, many of the details of the CMP apparatus 100 that are widely known and are not relevant to the present invention have been omitted. CMP apparatuses 100 are described in more detail in, for example, in commonly assigned, co-pending U.S. patent application Ser. No. 09/570,370, filed 12 May 2000 and entitled System and Method for Pneumatic Diaphragm CMP Head Having Separate Retaining Ring and Multi-Region Wafer Pressure Control; Ser. No. 09/570,369, filed 12 May 2000 and entitled System and Method for CMP Having Multi-Pressure Zone Loading For Improved Edge and Annular Zone Material Removal Control; and U.S. Provisional Application Ser. No. 60/204,212, filed 12 May 2000 and entitled System and Method for CMP Having Multi-Pressure Annular Zone Subcarrier Material Removal Control, each of which is incorporated herein by reference in its entirety.

The CMP apparatus 100 includes a base 110 rotatably supporting a large rotatable platen 115 with a polishing pad 120 mounted thereto, the polishing pad having a polishing surface 125 on which the substrate 105 is polished. The polishing pad 120 is typically a flexible, compressible or deformable material, such as a polyeurethane polishing pad available from RODEL Inc., of Newark, Del. Additionally, a number of underlying pads 126 can be mounted between the polishing pad 120 and the polishing platen 115 to provide a flatter polishing surface 125 having better contact with the surface of the substrate 105. Recesses (not shown), such as grooves or cavities, may be provided in the polishing surface 125 to distribute a chemical or slurry between the polishing surface and a surface of a substrate 105 placed thereon. By slurry it is meant a chemically active liquid having an abrasive material suspended therein that is used to enhance the rate at which material is removed from the substrate surface. Typically, the slurry is chemically active with at least one material on the substrate 105 and has a pH of from about 2 to about 11. For example, one suitable slurry consists of approximately 12% abrasive and 1% oxidizer in a water base, and includes a colloidal silica or alumina having a particle size of approximately 100 nanometers (nm). Optionally, as an alternative or in addition to the slurry, the polishing surface 125 of the polishing pad 120 can have a fixed abrasive material embedded therein, and the chemical dispensed onto the polishing surface during polishing operations can be water or deionized water.

The base 110 also supports a bridge 130 that in turn supports a carousel 135 having one or more polishing heads 140 on which substrates 105 are held during a polishing operation. The bridge 130 is designed to permit raising and lowering of the carousel 135 to bring surfaces of substrates 105 held on the polishing heads 140 into contact with the polishing surface 125 during the polishing operation. The particular embodiment of a CMP apparatus 100 shown in FIG. 4 is a multi-head design, meaning that there are a plurality of polishing heads 140 on the carousel 135; however, single head CMP apparatuses are known, and the inventive polishing head 140 and methods for polishing may be used with either a multi-head or single-head CMP apparatus. Furthermore, in this particular design, each of the polishing heads 140 are driven by a single motor 145 that drives a chain 150, which in turn drives each of the polishing heads via a chain and sprocket mechanism (not shown); however, the invention may be used in embodiments in which each polishing head 140 is rotated with a separate motor and/or by other than chain and sprocket type drives. In addition to the rotation of the polishing pad 120 and the polishing heads 140, the carousel 135 can be moved in an orbital fashion about a fixed central axis of the polishing platen 115 to provide an orbital motion to the polishing heads. Furthermore, the inventive polishing head 140 may be utilized in all manner of CMP apparatuses 100 including machines utilizing a linear or reciprocating motion.

The CMP apparatus 100 also incorporates a chemical dispensing mechanism (not shown) to dispense a chemical or slurry, as described above, onto the polishing surface 125 during the polishing operation, a controller (not shown) to control the dispensing of the slurry and movement of the polishing heads 140 on the polishing surface, and a rotary union (not shown) to provide a number of different fluid channels to communicate pressurized fluids such as air, water, vacuum, or the like between stationary sources external to the polishing head and locations on or within the polishing head.

A CMP apparatus 100 having a plurality of polishing heads 140 mounted on carousel 135 is described in U.S. Pat. No. 4,918,870 entitled Floating Subcarriers for Wafer Polishing Apparatus; a CMP apparatus 100 having a floating polishing head 140 is described in U.S. Pat. No. 5,205,082 Wafer Polisher head Having Floating Retainer Ring; and a rotary union for use in a polishing head 140 is described in U.S. Pat. No. 5,443,416 and entitled Rotary Union for Coupling Fluids in a Wafer Polishing Apparatus; each of which are hereby incorporated by reference.

Figure 5:
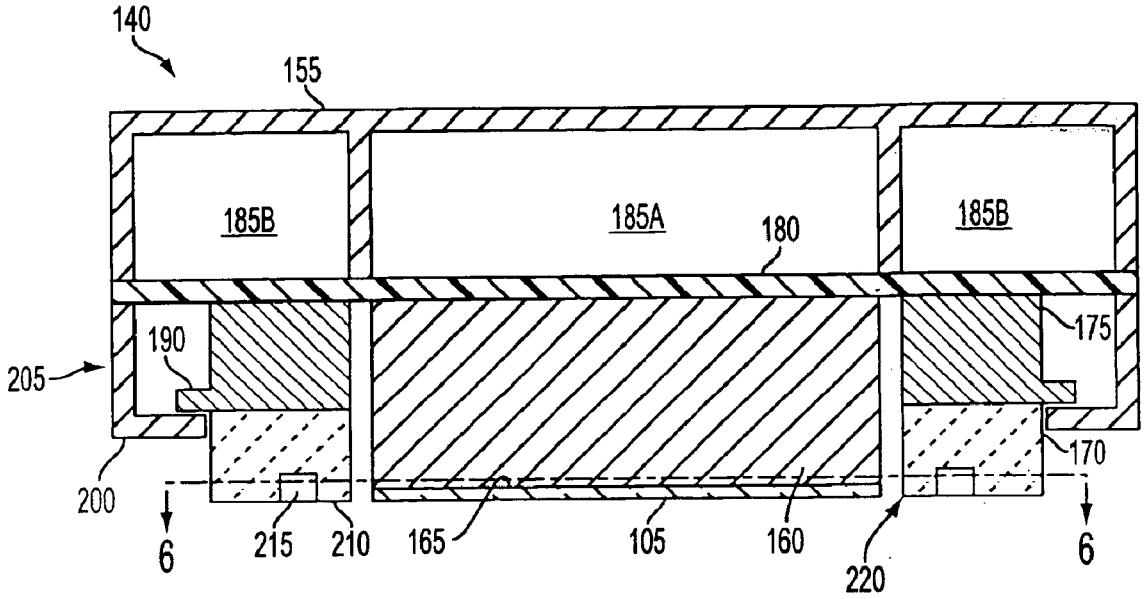
FIG. 5 is a diagrammatic illustration showing a cross-sectional side view of a polishing head having a retaining ring with a contoured lower surface according to an embodiment of the present invention.

An embodiment of a polishing head 140 according to the present invention will now be described with reference to FIG. 5. Referring to FIG. 5, the polishing head 140 includes a carrier 155 for holding and positioning the substrate 105 on the polishing surface 125 during the polishing operation. The carrier 155 typically includes a subcarrier 160 having a lower surface 165 on which the substrate 105 is held and a retaining ring 170 circumferentially disposed about a portion of the subcarrier. Generally, the polishing head 140 further includes a backing ring 175 for supporting and applying force to the retaining ring 170.

The subcarrier 160 and the backing ring 175, with the retaining ring 170 attached thereto, are suspended from the carrier 155 in such a way that they can move vertically with little friction and no binding. Small mechanical tolerances are provided between the subcarrier 160 and the retaining ring 170 and adjacent elements so that they are able to float on the polishing surface 125 in a manner that accommodates minor angular variations during the polishing operation.

Referring to FIG. 5, a gasket or flexible membrane 180 is joined via an adhesive or mechanical fastener (not shown) to the carrier 155 to form closed chambers or cavities 185A, 185B, above the subcarrier 160 and the backing ring 175 respectively. The subcarrier 160 and the backing ring 175 are also joined to the flexible membrane 180 via an adhesive or mechanical fastener (not shown) in such a way as to enable the subcarrier and the backing ring to move relative to one another and to the carrier 155 during the polishing operation. The backing ring 175 includes a projection or lip 190 along an outer surface that engages with a similar lip 200 on a skirt portion 205 of the carrier 155 to limit the downward movement of the retaining ring and to support the weight of the retaining ring 170 and subcarrier 160 when, for example, the polishing head 140 is lifted from the polishing surface 125.

In operation, the subcarrier 160 and the retaining ring 170 are independently or at least substantially independently biased or pressed against the polishing surface 125 while providing a slurry and relative motion between the substrate 105 and the polishing surface 125 to polish the substrate. The biasing force can be provided by springs (not shown), by the weight of the subcarrier 160 and the retaining ring 170 themselves or by a pressurized fluid. Preferably, as shown in FIG. 5, the subcarrier 160 and the retaining ring 170 are pressed against the polishing surface 125 by a pressurized fluid introduced into the cavities 185A, 185B. The use of a pressurized fluid is preferred since the application of the force is more uniform and more readily altered to adjust the polishing or removal rate. Generally, the pressure applied is in the range of between about 4.5 and 5.5 pounds per square inch (psi), more typically about 5 psi. However, these ranges are only exemplary as any of the pressures may be adjusted to achieve the desired polishing or planarization effects over the range from about 1 psi and about 10 psi. More preferably, the biasing force or pressure applied to the retaining ring 170 is usually greater than that applied to the subcarrier 160 to slightly deform the polishing surface 125 thereby reducing the edge effect and providing a more uniform rate of removal and planarization across the surface of the substrate 105. The edge effect refers to the tendency for the rate of removal of material to be greater at the surface near the edge of a substrate 105 than at a central portion due to the interaction of the polishing surface 125 with the edge of the substrate. By pressing down on and slightly deforming the polishing surface 125 near the edge of the substrate 105, the retaining ring 170 reduces the force with which the edge of the substrate is pressed against or encounters the polishing surface, thereby lowering the local removal rate to a level more nearly equal to that of other areas across the substrate surface.

In accordance with one aspect of the present invention, the retaining ring includes a contoured lower surface 210 having a groove or recess 215 therein to reduce the rebound effect. That is to reduce an area of the substrate surface near the edge of the substrate 105 that is separated from the polishing pad 120 during the polishing operation. As noted above, this separation is caused by the inability of the polishing pad 120 to rebound quickly enough following deformation by the retaining ring 170. It has been found that the area near the edge of the substrate 105 separated from the polishing pad 120 is a function of the speed with which the polishing pad moves past the polishing head 140 and the time it takes the polishing pad to rebound after it has been deformed by the retaining ring 170. It has also been found that the time it takes the polishing pad 120 to rebound after being deformed depends, inter alia, on the amount by which it has been deformed and by the length of time which it has been deformed. Thus, the addition of a recess to the lower surface 210 of the retaining ring 170 can reduce either or both of the amount of deformation and the length of time which the polishing pad 120 has been deformed immediately prior to passing under the substrate 105. Note, that the time it takes the polishing pad 120 to rebound also depends on the material properties of the polishing pad. Proper selection of the size, shape, number and location of the recess 215 or recesses can accommodate polishing pads 170 having a wide range of properties. For example, it has been found that a retaining ring 170 having a recess in the lower surface 210 according to the present invention can reduce the rebound effect for polishing pads 120 and underlying pads 126 made of a pliant or flexible a polymeric material, such as rubber or rubber-like materials, such as EPDM, EPR, or silicone, and having a Shore number of from about 10 to about 90. Moreover, by varying the size, shape, number and location of the recess 215 or recesses, the retaining ring 170 according to the present invention can reduce the rebound effect for polishing pads 120 having properties that vary over time.

Figure 6:
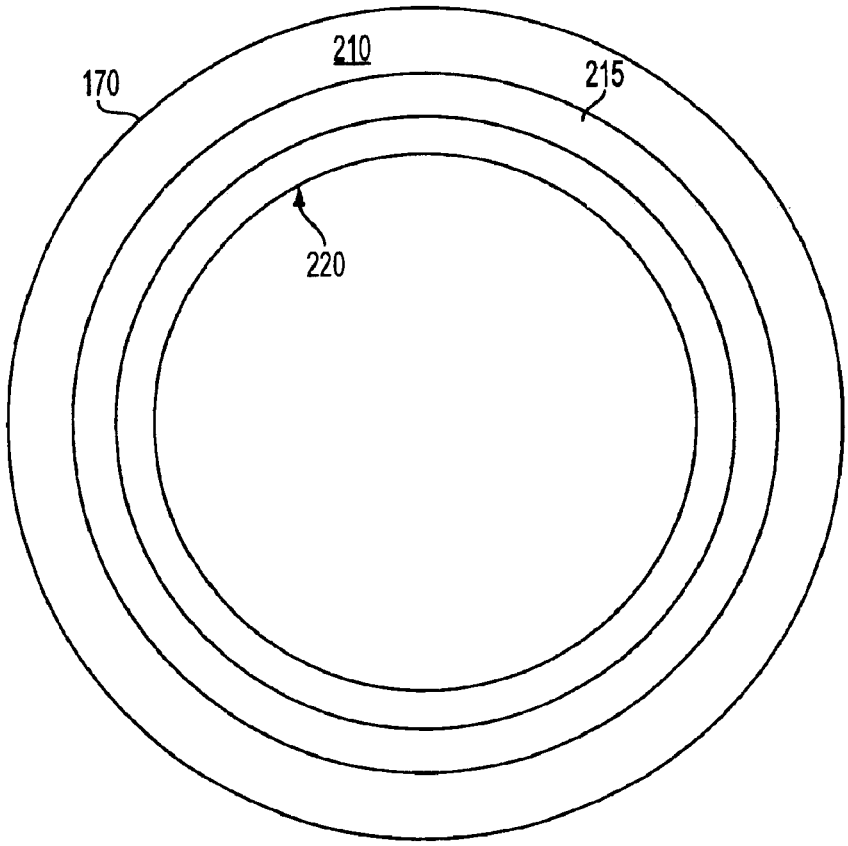
FIG. 6 is a plan view of the retaining ring of FIG. 5 taken along the line 6—6 of FIG. 5 showing an embodiment of the contoured lower surface according to an embodiment of the present invention.

In one embodiment of the inventive retaining ring 170, shown in FIGS. 5 and 6, the recess is an annular recess 215 a predetermined distance from an inner edge 220 of the retaining ring 170, and having a predetermined width, depth and shape selected to reduce or eliminate the rebound effect. The annular recess 215 shown in FIGS. 5 and 6, has a rectangular cross-section, viewed along a radial plane, wherein the width of the opening of the annular recess on the lower surface 210 is greater than the depth. Generally, the width, depth and location of annular recess 215 depend on the size of the retaining ring 170. For example, for a retaining ring 170 sized to accommodate a 300 mm substrate 105, an annular recess 215 similar to that shown would have a width of from about 0.1 to about 10 mm, and a depth of about 0.1 to about 5 mm, and would be located radially from about 1 to about 5 mm from the inner edge 220. In general, the dimensions and location of the recess 215 depends on the hardness of the polishing pad 120, and polishing operation parameters particularly the force applied to the retaining ring 170, and the speed with which the polishing head 140 is moved relative to the polishing surface 125.

Figure 7:
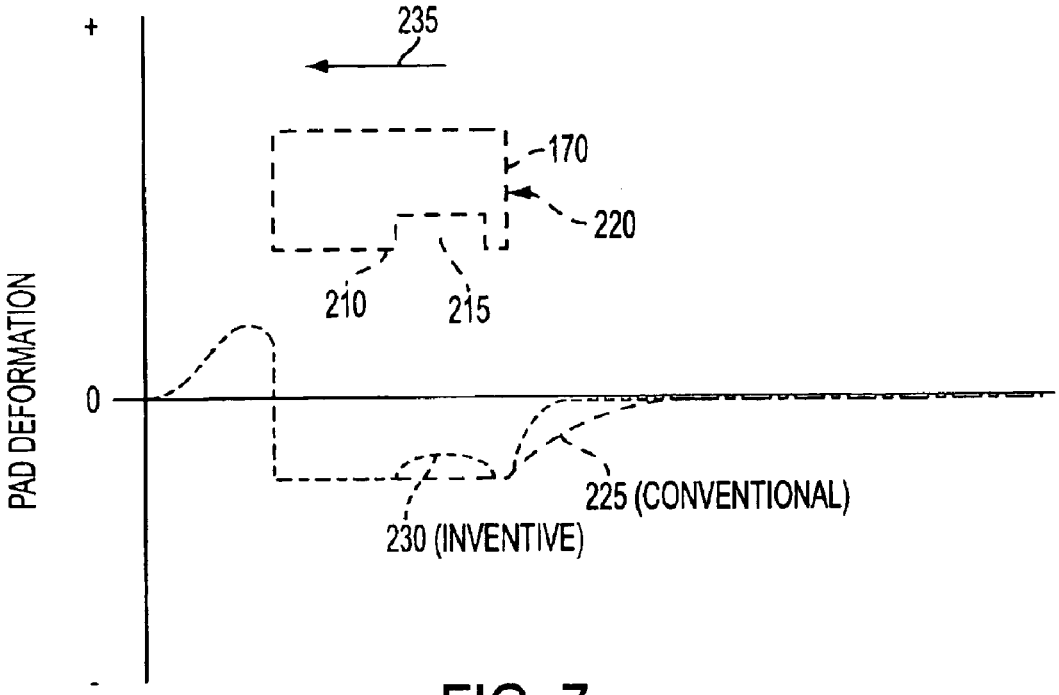
FIG. 7 is a graph showing the rebound effect caused be deformation of the polishing pad by a conventional retaining ring as compared to a retaining ring having a contoured lower surface according to an embodiment of the present invention.

FIG. 7 is a graph diagrammatically illustrating the rebound effect caused by deformation of the polishing pad 120 by a conventional retaining ring as compared to a retaining ring 170 having a contoured lower surface 210 according to the present invention. The graph shows the deformation caused solely by the leading side of the retaining ring 170. That is the portion of the retaining ring 170 closest to the direction of travel. Deformation due to a trailing side would be similar. It should also be noted that the magnitude of deformation of the polishing surface 125 both ahead of and under the retaining ring 170 have been exaggerated in relation to the size of the retaining ring to illustrate the operation of the present invention. The horizontal axis represents the profile of an undeformed polishing surface 125. Dashed line 225 indicates the profile of a polishing surface 125 as deformed by a conventional retaining ring having a flat lower surface. Dotted line 230 indicates the profile of the polishing surface 125 as deformed by a retaining ring 170 having a contoured lower surface 210 according to an embodiment of the present invention. A partial cross-sectional side view of a retaining ring 170 according to an embodiment of the present invention is shown in phantom above the deformation in the polishing surface 125 to the effect of the recess 215 on the rebound profile. As shown in FIG. 7, when the polishing head 140 is moving relative to the polishing surface 120 in a direction indicated by arrow 235, both the conventional retaining ring and the inventive retaining ring 170 will cause an upward deformation of the polishing surface 125 as indicated by the overlying lines 225 and 230. However, as the polishing surface 125 moves under the lower surface 210 of the retaining ring 170, the annular recess 215 allows the polishing pad 120 to partially rebound, as shown by dotted line 230, thereby causing the polishing pad to fully rebound more quickly, in a shorter distance from the inner edge 220 than with the conventional retaining ring. Thus, reducing the area near the edge of the substrate 105 separated from the polishing surface 125. The width, depth and shape of the recess 215 may be modified to provide the desired rebound characteristics in conjunction with the polishing operation pressure and speed.

Alternative embodiments of retaining rings according to the present invention will now be described with reference to FIGS. 8 through 15B.

Figure 8:
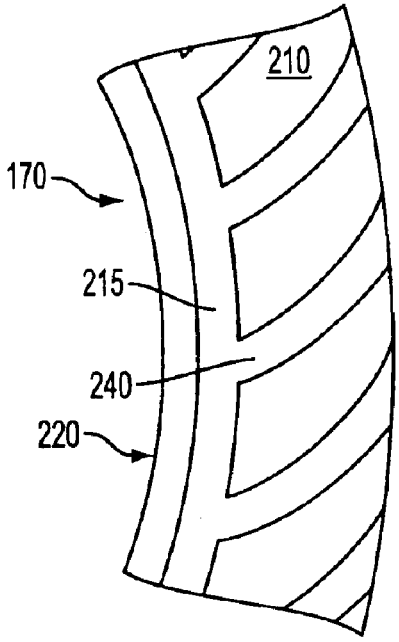
FIG. 8 is a partial cross-sectional side view of a retaining ring similar to that shown in FIG. 7, but having additional radial grooves according to an alternative embodiment of the present invention.

FIG. 8 shows a partial cross-sectional side view of a retaining ring 170 similar to that shown in FIG. 6, but having additional radial grooves 240 according to an alternative embodiment of the present invention. The radial grooves 240 act to distribute the slurry between the polishing surface 125 and the surface of the substrate 105 placed thereon. Generally, the radial grooves 240 need not have the same dimensions as the recess 215 and may or may not be uniformly spaced apart across the lower surface 210 of the retaining ring 170. However, in a embodiment preferred for ease of manufacture, the radial grooves 240 are spiral shaped and have dimensions similar to those of the recess 215. That is the radial grooves 240 have a width of from about 0.1 to about 10 mm, and a depth of about 0.1 to about 5 mm. In addition, although the radial grooves 240 are shown as terminating in the recess 215, the radial grooves can extend through the recess to terminate on the inner edge 220 of the retaining ring 170.

Figure 9:
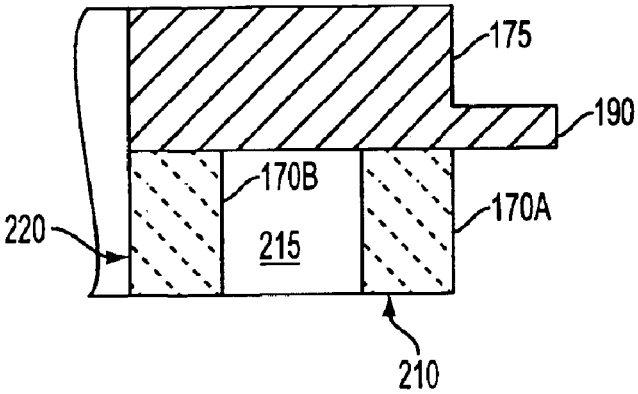
FIG. 9 is a partial cross-sectional side view of a pair of concentric retaining rings showing an alternative embodiment according to the present invention.

FIG. 9 shows a partial cross-sectional side view of a pair of concentric retaining rings 170A, 170B according to an alternative embodiment of the present invention. The vertical height of the retaining rings 170A, 170B and the space therebetween is selected to provide the desired rebound characteristics. Although shown as two concentric retaining rings 170A, 170B, it will be appreciated that any number of properly sized retaining rings can be used without departing from the scope of the present invention. Also, while the concentric retaining rings 170A, 170B shown are of equal vertical height and cross-sectional width, either or of both of these properties can be varied from ring to ring to further reduce or tailor the rebound effect. For example, the innermost ring 170B may have a reduced height or width to further reduce deformation of the polishing pad 120 immediately before it passes under the substrate 105.

Figure 10A:
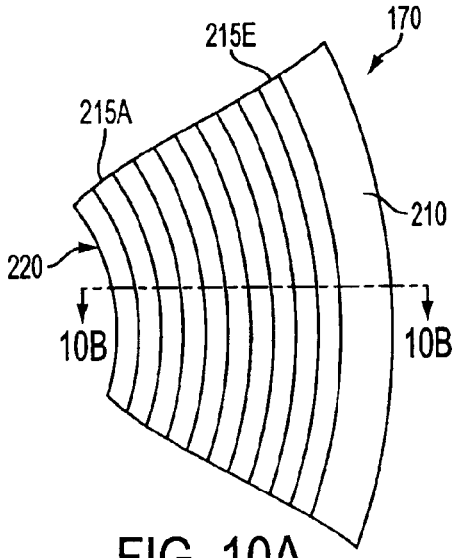
FIG. 10A is a partial view of a retaining ring having a contoured lower surface according to an alternative embodiment of the present invention.
Figure 10B:
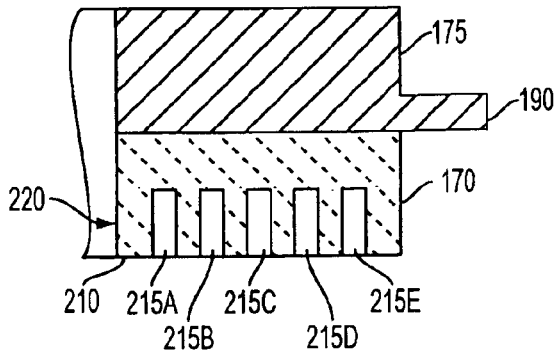
FIG. 10B is a partial cross-sectional side view of the retaining ring of FIG. 10A taken along the line 10—10.

FIGS. 10A and 10B show a partial view of a retaining ring 170 having a lower surface 210 with a number of concentric annular recesses 215A to 215E formed therein. This embodiment provides a reduction in rebound effect substantially the same as would be achieved by a single groove having a width equal to the combined width of the concentric annular recesses 215A to 215E without substantially impacting the strength or lifetime of the retaining ring 170. That is whereas a single large annular recess 215 might weaken the retaining ring 170 and, by reducing the area of the lower surface in contact with the polishing surface, increase a rate at which is ground away, multiple concentric annular recesses 215A to 215E will not. A further advantage of this embodiment is that it allows a manufacturer to quickly produce retaining rings 170 to match a customer's specific application. For example, all retaining rings can be initially manufactured to have a predetermined minimum number of annular recesses 215. If reduction of the rebound effect is most important, additional concentric annular recesses can be added. Conversely, if a longer lifetime is more important the retaining ring 170 can be used with the predetermined minimum number of annular recesses 215.

Figure 11A:
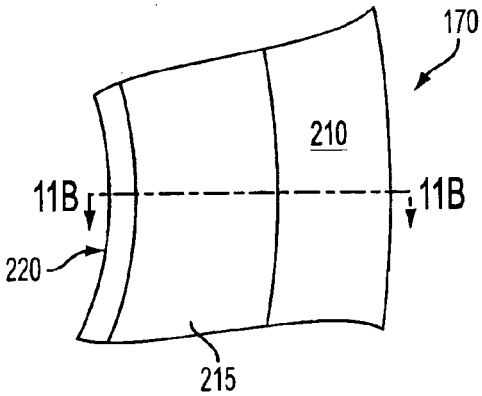
FIG. 11A is a partial view of a retaining ring having a contoured lower surface according to another alternative embodiment of the present invention.
Figure 11B:
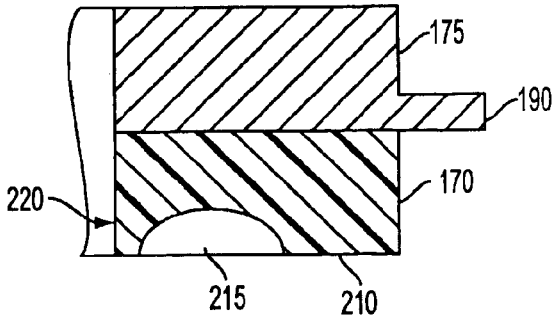
FIG. 11B is a partial cross-sectional side view of the retaining ring of FIG. 11A taken along the line 11—11.

FIGS. 11A and 11B show a retaining ring 170 having a lower surface 210 with an annular recess 215 having a curved or hemispherical cross-sectional formed therein. Because the polishing pad 120 rebounding into the annular recess 215 will typically form a curved surface regardless of the shape of the cross-sectional area of the annular recess, this embodiment provides a reduction in rebound effect substantially the same as that of the retaining ring 170 shown in FIGS. 5 and 6. However, because less material is removed from the retaining ring 170, the annular recess is (i) easier to form by machining process, and (ii) generally results in a stronger retaining ring. This last advantage is particularly important where the retaining ring is made of a softer, more ductile material, such as a polymer as shown in FIGS. 11A through 13.

Figure 12:
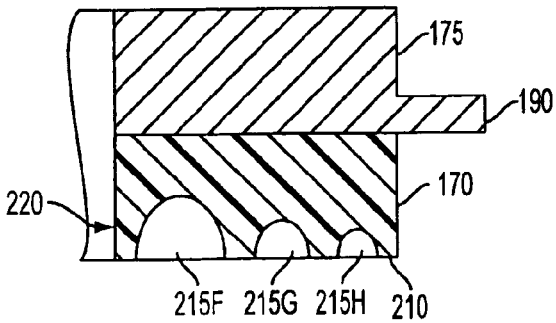
FIG. 12 is a partial cross-sectional side view of a retaining ring having a contoured lower surface according to yet another alternative embodiment of the present invention.

FIG. 12 shows a partial cross-sectional side view of a retaining ring 170 having a lower surface 210 with a number of concentric annular recesses 215F to 215H having a curved cross-sectional area formed therein. As in the embodiment shown in FIGS. 10A and 10B above, this embodiment provides a reduction in rebound effect substantially the same as would be achieved by a wider single groove.

Figure 13:
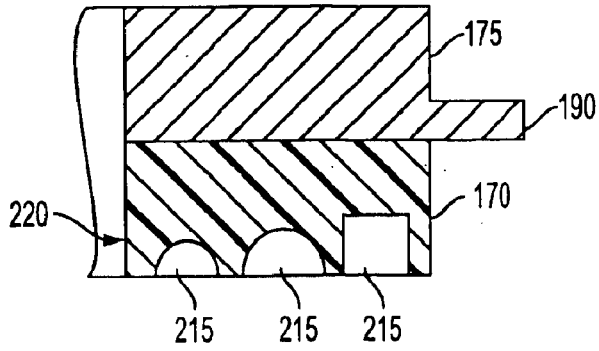
FIG. 13 is a partial cross-sectional side view of a retaining ring having a contoured lower surface according to still another alternative embodiment of the present invention.

FIG. 13 shows a partial cross-sectional side view of a retaining ring 170 similar to that shown in FIG. 12, and illustrates that the recesses 215 need not be of the same size or have the same cross-sectional shape.

Figure 14:
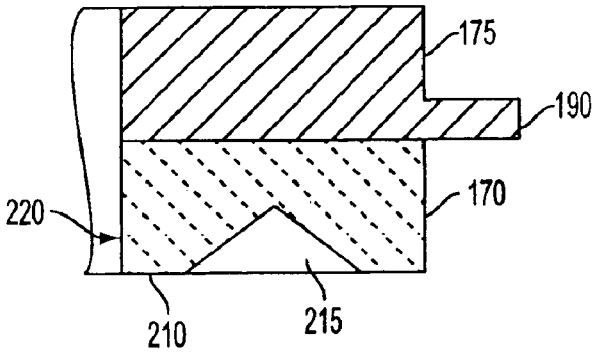
FIG. 14 is a partial cross-sectional side view of a retaining ring having a contoured lower surface according to another alternative embodiment of the present invention.

FIG. 14 illustrates yet another alternative embodiment of a retaining ring 170 according to the present invention. FIG. 14 shows a partial cross-sectional side view of a retaining ring 170 having an annular recess 215 with a triangular cross-sectional shape. When the annular recess 215 is properly sized, this embodiment provides a reduction in rebound effect similar to that of the retaining ring of FIGS. 5, 9 and 11A, while affording the additional advantage of ease of machining. This particularly the case where the retaining ring 170 is made from a hard, brittle ceramic material.

Figure 15A:
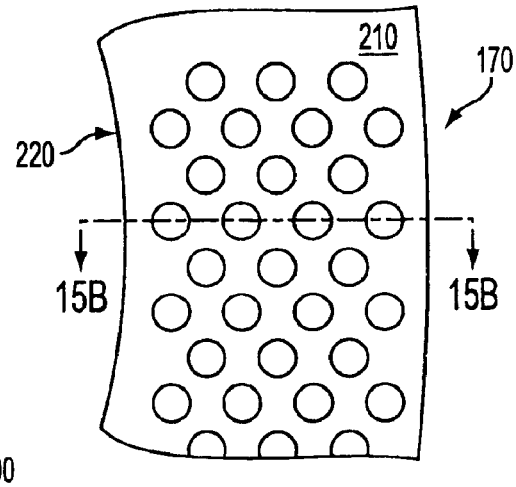
FIG. 15A is a partial view of a retaining ring having a contoured lower surface according to another alternative embodiment of the present invention.
Figure 15B:
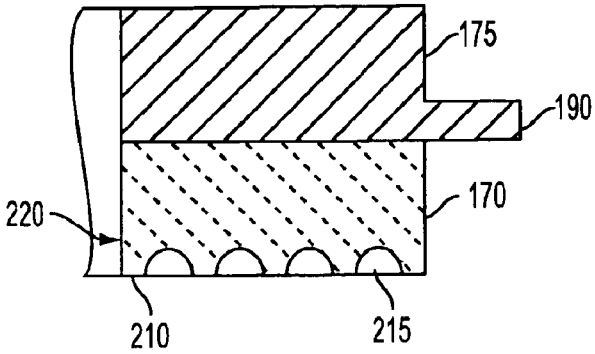
FIG. 15B is a partial cross-sectional side view of the retaining ring of FIG. 15A taken along the line 15—15.
Figure 16:
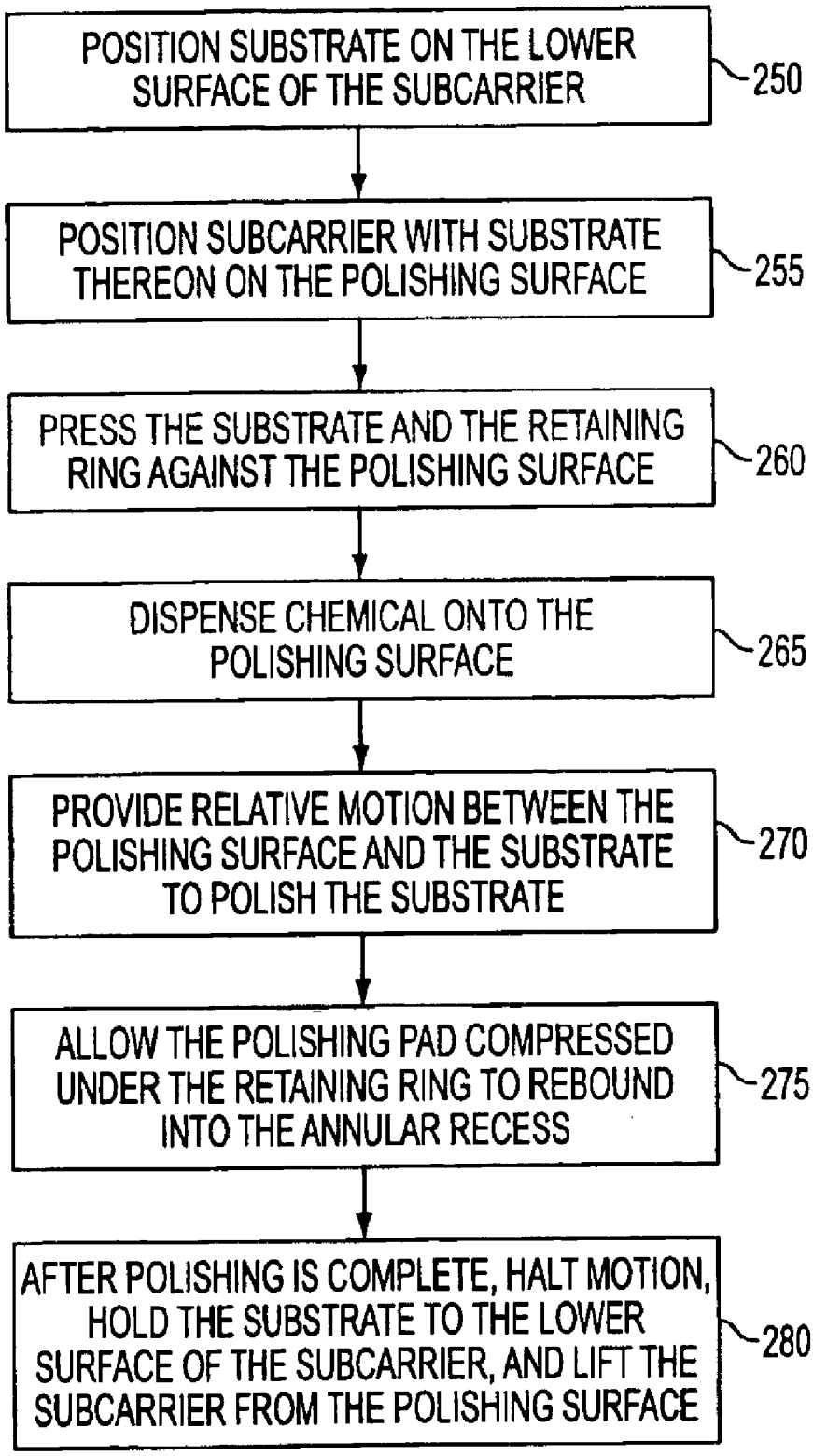
FIG. 16 is a flowchart showing an embodiment of a process for polishing or planarizing a substrate according to an embodiment of the present invention.

FIGS. 15A and 15B illustrate still another embodiment of a retaining ring 170 having a lower surface 210 with recesses 215 formed therein to reduce the rebound effect. In the embodiment shown in FIGS. 15A and 15B the recesses 215 include a number of individual recesses distributed across the lower surface 210 of the retaining ring 170. As in above embodiments, the size, number and location of the individual recesses 215 need not be the same and can be varied to further reduce or tailor the rebound effect.

In another aspect the present invention is directed to a retaining ring 170 made of a polymer, as shown in FIGS. 11B to 13, to reduce or eliminate potential damage to the substrate 105 during the polishing operation due to spalling or chipping of material from the lower surface 210 of the retaining ring, as is common with conventional ceramic retaining rings. Use of a polymer or polymeric material is desirable to reduce the potential for damage to the substrate 105 that can occur with conventional retaining rings made of a ceramic material due to chipping or spalling of the lower surface. In addition, use of polymer materials makes the retaining ring less susceptible to damage during installation, lead to reduced downtime for changing the retaining rings. Heretofore, polymers have not generally been successfully used in retaining rings due to a reduced lifetime for the resulting retaining ring. As noted above, retaining rings are generally considered consumable items that must be replaced regularly. However, short lifetimes for the retaining rings lead to the need for frequent replacement, and cause significant increase in operating cost of the CMP system and in downtime of the CMP system.

It has been discovered that retaining rings 170 comprising one or more of the following polymers will reduce or eliminate the potential for damage due to spalling, while providing substantially the same lifetime as a conventional ceramic retaining ring. These polymers include: polyesters; polyethylene terephthalate; polyimide; polyphenylene sulfide; polyetherketone; and polybenzimidazole. Preferably, the polymer is selected to provide an operating life for the retaining ring of at least about 70 hours, and more preferably an operating life adequate for processing from about 2,000 to about 10,000 substrates.

It is noted that the retaining ring 170 need not be manufactured entirely of a single homogeneous polymer or even entirely of a polymer. For example, in another embodiment (not shown), the retaining ring 170 can be manufactured with a polymer, metal or ceramic core overlain in part or entirely by a layer of a second polymer selected from those enumerated above. This embodiment has the advantage of providing a retaining ring 170 having a desirable characteristic such as weight, cost or stiffness, while still providing resistance to spalling according to the present invention.

An embodiment of a method for operating a CMP apparatus 100 according to the present invention will now be described with reference to FIG. 11. In an initial or loading step a substrate 105 is received on the lower surface 165 of the subcarrier 160 (Step 250). Generally, the substrate 105 is held to the lower surface 165 by vacuum drawn through a port (not shown) in the lower surface. The substrate 105 is positioned on the polishing surface 125 (Step 255) and a pressurized fluid introduced into cavities 185A, 185B, to press the substrate 105 and the retaining ring against the polishing surface (Step 260). A chemical, such as water or a slurry, is dispensed onto the polishing surface 125 (Step 265) and distributed between the substrate 105 and the polishing surface. Relative motion is provided between the polishing surface 125 and the substrate 105 to polish the substrate (Step 270). In accordance, with the present invention, the polishing pad 120 compressed or deformed under the retaining ring 170 is allowed to partially or completely rebound into the annular recess 215, thereby reducing or eliminating the rebound effect (Step 275). After polishing is complete and rotation of the polishing head 140, and polishing platen 115 is stopped, vacuum is again used to hold the substrate 105 to the lower surface 165, and the substrate is lifted from the polishing surface 125 (Step 280).

It is to be understood that even though numerous characteristics and advantages of certain embodiments of the present invention have been set forth in the foregoing description, together with details of the structure and function of various embodiments of the invention, this disclosure is illustrative only, and changes may be made in detail, especially in matters of structure and arrangement of parts within the principles of the present invention to the full extent indicated by the broad general meaning of the terms in which the appended claims are expressed.

What is claimed is:

1. A polishing head for polishing a surface of a substrate against a polishing pad surface to achieve an even removal of material near the substrate surface edge and interior to the substrate surface edge, the polishing pad surface having a hardness and undergoing a deformation when a pressure force is applied and having at least a partial rebound from the deformation in a first time period after a portion of the pressure force is removed and having a full rebound in a second time period after all the pressure force is removed, the polishing pad being viscoelastic so that it exhibits different elastic properties to force applied in different directions or for different lengths of times and having a thickness that changes over time, the polishing head comprising:

a carrier;

a subcarrier carried by the carrier and adapted to hold the substrate during a polishing operation; and a retaining ring having an inner edge disposed about the subcarrier and a lower surface in contact with the polishing surface during the polishing operation, the lower surface of the retaining ring having at least one recess disposed along a substantially annular path on the lower surface of the retaining ring and sized in width and depth so that the polishing pad surface adjacent the recess at any moment during polishing partially rebounds an amount of the polishing pad into the recess so that the polishing pad surface fully rebounds in a shorter time and in a shorter distance after moving under the substrate across the inner edge of the retaining ring, the force on the substrate in an area near the outer edge of the substrate being thereby adiusted to achieve a predetermined polishing effect where the amount of material removed from the substrate surface edge is substantially the same as the amount of material removed interior to the substrate surface edge, the at least one recess positioned a predetermined distance from the inner edge of the retaining ring, selected based on a magnitude of a first force applied to the retaining ring during the polishing operation, a magnitude of a second force applied to the subcarrier during the polishing operation, or both.

2. A polishing head according to claim 1, wherein said at least one recess comprises at least one annular recess.

3. A polishing head according to claim 2, wherein the polishing surface comprises a pad of pliant material capable of being deformed by the retaining ring during the polishing operation.

4. A polishing head according to claim 3, wherein the at least one annular recess is adapted to reduce a length of time during which the polishing surface is deformed by the retaining as the retaining ring is moved relative to the polishing surface.

5. A polishing head according to claim 1, wherein the at least one annular recess is positioned a predetermined distance from the inner edge of the retaining ring, the predetermined distance selected to reduce the area near the edge of the substrate having a lower polishing rate than a center of the substrate due to rebounding of the pad.

6. A polishing head according to claim 1, wherein the predetermined distance is selected based on a hardness of the polishing surface.

7. A polishing head according to claim 1, wherein the at least one annular recess comprises a plurality of concentric grooves.

8. A Chemical Mechanical Polishing (CMP) apparatus having a polishing head according to claim 1, the CMP apparatus further comprising:

a chemical dispensing mechanism adapted to dispense chemical onto the polishing surface during the polishing operation; and a drive mechanism adapted to move the polishing head relative to the polishing surface during the polishing operation.

9. A polishing head according to claim 1, wherein the retaining ring comprises a polymer to inhibit spalling of the lower surface during the polishing operation.

10. A polishing head according to claim 9, wherein the polymer is selected to provide an operating life for the retaining ring adequate for processing at least about 2,000 substrates.

11. A polishing head according to claim 9, wherein the retaining ring is made entirely or in part of a polymer selected from a group consisting of:

polyesters;

polyethylene terephthalate;

polyimide;

polyphenylene sulfide;

polyetherketone; and polybenzimidazole.

12. A polishing head according to claim 1, wherein said at least one recess comprises a plurality of individual recesses distributed across the lower surface of the retaining ring, each at a predetermined distance from the inner edge of the retaining ring.

13. A polishing head according to claim 12, wherein the plurality of individual recesses distributed across the lower surface of the retaining ring comprise a plurality of individual unconnected apertures that open onto the lower surface of the retaining ring.

14. A polishing head according to claim 13, wherein plurality of individual unconnected apertures that open onto the lower surface of the retaining ring comprise apertures having a substantially circular opening onto the lower surface of the retaining ring and a hemispherical cross-sectional area.

15. A polishing head according to claim 13, wherein plurality of individual unconnected apertures that open onto the lower surface of the retaining ring comprise apertures wherein the individual aperture recesses have a number, an area, a size, and a location that differ between at least some of the recesses and are different from other or the aperture recesses and are varied to achieve a desired polishing pad rebound.

16. A polishing head according to claim 1, wherein the predetermined distance for the or each recess is selected based on both the magnitude of the force applied to the retaining ring during the polishing operation and the magnitude of the force applied to the subcarrier during the polishing operation.

17. A polishing head according to claim 1, wherein the retaining ring is sized for a 300 mm diameter substrate, the recess includes an annular groove positioned from 1 mm to 5 mm from the inner edge of the retaining ring and having a width of from 0.1 mm to 10 mm and a depth of from 0.1 mm to 5 mm.

18. A polishing head according to claim 1, wherein the at least one recess comprises a plurality of annular groove shaped recesses wherein at least a first one of the plurality of annular groove shaped recesses has a different depth from a second one of the plurality of annular groove shaped recesses.

19. A polishing head according to claim 1, wherein the at least one recess comprises a plurality of annular groove shaped recesses, and wherein at least a first one of the plurality of annular groove shaped recesses has a different width from a second one of the plurality of annular groove shaped recesses.

20. A polishing head according to claim 1, wherein the at least one recess comprises a plurality of annular groove shaped recesses, and wherein at least a first one of the plurality of annular groove shaped recesses has a different depth and width from a second one of the plurality of annular groove shaped recesses.

21. A polishing head according to claim 1, wherein the at least one recess comprises a plurality of separate retaining rings disposed in spaced-apart relationship to define spaces there between having depths and widths defined by the vertical height of the spaced apart retaining rings.

22. A polishing head according to claim 1, wherein the at least one recess comprises a separate first and second retaining rings disposed in spaced-apart relationship to define a space there between having a depth and width defined by the vertical height of the first and second retaining rings.

23. A polishing head according to claim 1, wherein the at least one recess has a triangular cross-section.

24. A polishing head according to claim 1, wherein the retaining ring is formed with a ceramic core and a polymer covering.

25. A polishing head according to claim 1, wherein the width, depth, shape, and location of the at least one recess is selected based on the hardness of the polishing pad, the force applied to the retaining ring, and the speed with which the polishing head is moved relative to the polishing surface during a polishing operation.

26. A polishing head for polishing a surface of a substrate against a polishing pad surface to achieve an even removal of material near the substrate surface edge and interior to the substrate surface edge, the polishing pad surface having a hardness and undergoing a deformation when a pressure force is applied and having at least a partial rebound from the deformation in a first time period after a portion of the pressure force is removed and having a full rebound in a second time period after all the pressure force is removed, the polishing pad being viscoelastic so that it exhibits different elastic properties to force applied in different directions or for different lengths of times and having a thickness that chanoes over time, the polishing head comprising:

a carrier;

a subcarrier carried by the carrier and adapted to hold the substrate during a polishing operation; and a retaining ring having an inner edge disposed about the subcarrier and a lower surface in contact with the polishing surface during the polishing operation, the lower surface of the retaining ring having at least one annular recess disposed along a substantially annular path on the lower surface of the retaining ring and sized in width and depth so that the polishing pad surface adjacent the recess at any moment during polishing partially rebounds an amount of the polishing pad into the recess so that the polishing pad surface fully rebounds in a shorter time and in a shorter distance after moving under the substrate across the inner edge of the retaining ring, the force on the substrate in an area near the outer edge of the substrate being thereby adjusted to achieve a predetermined polishing effect where the amount of material removed from the substrate surface edge is substantially the same as the amount of material removed interior to the substrate surface edge, the annular recess having a predetermined depth and a predetermined radial width, the predetermined depth and the predetermined radial width selected based on a magnitude of a first force applied to the retaining ring during the polishing operation a magnitude of a second force applied to the subcarrier during the polishing operation, or both.

27. A polishing head according to claim 26, wherein the predetermined depth and a predetermined radial width are selected to reduce the area near the edge of the substrate having a lower polishing rate than a center of the substrate due to rebounding of the polishing surface.

28. A polishing head according to claim 26, wherein the predetermined depth and the predetermined radial width are selected based on a hardness of the polishing surface.

29. A polishing head according to claim 26, the predetermined depth and the predetermined radial width are selected based on the magnitude of the first force applied to the retaining ring during the polishing operation, and the magnitude of the second force applied to the subcarrier during the polishing operation.

30. A polishing head according to claim 26, wherein the at least one annular recess comprises a plurality of concentric grooves.

31. A Chemical Mechanical Polishing (CMP) apparatus having a polishing head according to claim 26, the CMP apparatus further comprising:

a chemical dispensing mechanism adapted to dispense chemical onto the polishing surface during the polishing operation; and a drive mechanism adapted to move the polishing head relative to the polishing surface during the polishing operation.

32. A polishing head for polishing a surface of a substrate against a polishing surface to achieve an even removal of material near the substrate surface edge and interior to the substrate surface edge, the polishing pad surface having a hardness and undergoing a deformation when a pressure force is applied and having at least a partial rebound from the deformation in a first time period after a portion of the pressure force is removed and having a full rebound in a second time period after all the pressure force is removed, the polishing pad being viscoelastic so that it exhibits different elastic properties to force applied in different directions or for different lengths of times and having a thickness that changes over time, the polishing head comprising:

a carrier;

a subcarrier carried by the carrier and adapted to hold the substrate during a polishing operation; and a retaining ring having an inner edge disposed about the subcarrier and a lower surface in contact with the polishing surface during the polishing operation, the lower surface of the retaining ring having at least one annular recess disposed along a substantially annular path on the lower surface of the retaining ring and sized in width and depth so that the polishing pad surface adjacent the recess at any moment during polishing partially rebounds an amount of the polishing pad into the recess so that the polishing pad surface fully rebounds in a shorter time and in a shorter distance after moving under the substrate across the inner edge of the retaining ring, the force on the substrate in an area near the outer edge of the substrate being thereby adjusted to achieve a predetermined polishing effect where the amount of material removed from the substrate surface edge is substantially the same as the amount of material removed interior to the substrate surface edge, the annular recess positioned a predetermined distance from the inner edge of the retaining ring selected based on a magnitude of a first force applied to the retaining ring during the polishing operation, a magnitude of a second force applied to the subcarrier during the polishing operation, or both, and wherein the at least one annular recess comprises a groove having a curved cross-sectional area in a plane perpendicular to the lower surface of the retaining ring.

33. A polishing head according to claim 32, wherein the groove comprises a hemispherical cross-sectional area.

34. A polishing head according to claim 32, wherein the at least one annular recess comprises a plurality of concentric grooves.

35. A Chemical Mechanical Polishing (CMP) apparatus having a polishing head according to claim 32, the CMP apparatus further comprising:

a chemical dispensing mechanism adapted to dispense chemical onto the polishing surface during the polishing operation; and a drive mechanism adapted to move the polishing head relative to the polishing surface during the polishing operation.

36. A method of polishing a substrate having a surface using a polishing apparatus comprising a polishing surface, a carrier having a subcarrier and a retaining ring circumferentially disposed about the subcarrier, the retaining ring having a lower surface with at least one recess formed therein, the method comprising:

selecting the at least one recess to be disposed along a substantially annular path on the lower surface of the retaining ring and sized in width and depth so that the polishing pad surface adjacent the recess at any moment during polishing partially rebounds an amount of the polishing pad into the recess so that the polishing pad surface fully rebounds in a shorter time and in a shorter distance after moving under the substrate across the inner edge of the retaining ring, the force on the substrate in an area near the outer edge of the substrate being thereby adjusted to achieve a predetermined polishing effect where the amount of material removed from the substrate surface edge is substantially the same as the amount of material removed interior to the substrate surface edge, the at least one recess positioned a predetermined distance from the inner edge of the retaining ring selected based on a magnitude of a first force applied to the retaining ring during the polishing operation, a magnitude of a second force applied to the subcarrier during the polishing operation, or both:

positioning the substrate on the subcarrier;

pressing the surface of the substrate and the lower surface of the retaining ring against the polishing surface and deforming the polishing surface under the retaining ring;

providing relative motion between the carrier and the polishing surface to polish the surface of the substrate; and enabling the polishing pad surface deformed under the retaining ring to partially rebound within the recess, the at least one recess positioned a predetermined distance from the inner edge of the retaining ring, the predetermined distance selected to reduce the area near the edge of the substrate having a lower polishing rate than a center of the substrate due to rebounding of the polishing surface, the predetermined distance selected based on a magnitude of a first force applied to the retaining ring during a polishing operation, a magnitude of a second force applied to the subcarrier during the polishing operation, or both.

37. A method according claim 36, wherein the polishing surface comprises a pad of pliant material capable of being deformed by the retaining ring during the polishing operation and wherein the step of pressing the lower surface of the retaining ring against the polishing surface comprises the step of reducing an area near an edge of the substrate having a lower polishing rate than a center of the substrate due to rebounding of the pad from a deformed condition in a first region near the inner edge of the retaining ring.

38. A substrate having a surface polished according to the method of claim 36.

39. A method according to claim 36, wherein the recess comprises an annular recess.

40. A method of polishing a substrate having a surface using a polishing apparatus comprising a polishing surface, a carrier having a subcarrier and a retaining ring circumferentially disposed about the subcarrier, the retaining ring having a lower surface with at least one recess formed therein, the method comprising:

selecting the at least one recess to be disposed along a substantially annular path on the lower surface of the retaining ring and sized in width and depth so that the polishing pad surface adjacent the recess at any moment during polishing partially rebounds an amount of the polishing pad into the recess so that the polishing pad surface fully rebounds in a shorter time and in a shorter distance after moving under the substrate across the inner edge of the retaining ring, the force on the substrate in an area near the outer edge of the substrate being thereby adjusted to achieve a predetermined polishing effect where the amount of material removed from the substrate surface edge is substantially the same as the amount of material removed interior to the substrate surface edge, the at least one recess positioned a predetermined distance from the inner edge of the retaining ring selected based on a magnitude of a first force applied to the retaining ring during the polishing operation, a magnitude of a second force applied to the subcarrier during the polishing operation, or both:

positioning the substrate on the subcarrier;

pressing the surface of the substrate and the lower surface of the retaining ring against the polishing surface and deforming the polishing surface under the retaining ring;

providing relative motion between the carrier and the polishing surface to polish the surface of the substrate; and enabling the polishing pad surface deformed under the retaining ring to partially rebound within the at least one recess, the at least one recess having a predetermined depth and a predetermined radial width, the predetermined depth and the predetermined radial width selected based on a magnitude of a first force applied to the retaining ring during a polishing operation, a magnitude of a second force applied to the subcarrier during the polishing operation, or both.

41. A substrate having a surface polished according to the method of claim 40.

42. A method of polishing a substrate having a surface using a polishing apparatus comprising a polishing surface, a carrier having a subcarrier and a retaining ring circumferentially disposed about the subcarrier, the retaining ring having a lower surface with an annular recess formed therein, the method comprising:

selecting the at least one recess to be disposed along a substantially annular path on the lower surface of the retaining ring and sized in width and depth so that the polishing pad surface adjacent the recess at any moment during polishing partially rebounds an amount of the polishing pad into the recess so that the polishing pad surface fully rebounds in a shorter time and in a shorter distance after moving under the substrate across the inner edge of the retaining ring, the force on the substrate in an area near the outer edge of the substrate being thereby adjusted to achieve a predetermined polishing effect where the amount of material removed from the substrate surface edge is substantially the same as the amount of material removed interior to the substrate surface edge, the at least one recess positioned a predetermined distance from the inner edge of the retaining ring selected based on a magnitude of a first force applied to the retaining ring during the polishing operation, a magnitude of a second force applied to the subcarrier during the polishing operation, or both:

positioning the substrate on the subcarrier;

pressing the surface of the substrate and the lower surface of the retaining ring against the polishing pad surface, deforming the polishing surface under the retaining ring;

providing relative motion between the carrier and the polishing pad surface to polish the surface of the substrate; and enabling the polishing pad surface deformed under the retaining ring to partially rebound within the annular recess, wherein the annular recess comprises a groove having a curved cross-sectional area in a plane perpendicular to the lower surface of the retaining ring.

43. A substrate having a surface polished according to the method of claim 42.

* * * * *